US006267586B1

(12) United States Patent
Maricic

(10) Patent No.: US 6,267,586 B1
(45) Date of Patent: Jul. 31, 2001

(54) LOW NOX BURNER

(75) Inventor: Richard Maricic, Parma, OH (US)

(73) Assignee: Beckett Gas, Inc., Elyria, OH (US)

( * ) Notice: Subject to any disclaimer, the term of this patent is extended or adjusted under 35 U.S.C. 154(b) by 0 days.

(21) Appl. No.: 09/565,107

(22) Filed: May 5, 2000

(51) Int. Cl.[7] ..... F23D 14/06; F23D 14/58

(52) U.S. Cl. ..... 431/354; 431/10

(58) Field of Search ..... 431/8, 10, 354, 431/352, 349; 126/39 E, 39 R, 39 H; 239/554, 553.3, 553.5, 552, 567

(56) References Cited

U.S. PATENT DOCUMENTS

| | | | | |
|---|---|---|---|---|
| 997,278 | * | 7/1911 | Donnelly . | |
| 2,220,247 | * | 11/1940 | Kochendorfer et al. . | |
| 5,427,525 | * | 6/1995 | Shukla et al. | 431/10 |
| 5,494,437 | * | 2/1996 | Kubota et al. | 431/10 |
| 5,649,822 | * | 7/1997 | Gertler et al.. | 431/354 |
| 5,879,154 | * | 3/1999 | Suchovsky | 126/39 E |
| 5,913,675 | | 6/1999 | Vago et al. . | |
| 5,937,796 | * | 8/1999 | Sebastiani | 126/39 E |
| 5,954,492 | * | 9/1999 | Lannes et al. | 431/354 |
| 5,975,887 | * | 11/1999 | Kamal et al. . | |
| 6,082,994 | * | 7/2000 | Grandveau et al. | 431/349 |

FOREIGN PATENT DOCUMENTS

| | | | | |
|---|---|---|---|---|
| 31 36 140 | * | 4/1982 | (DE) | 431/349 |
| 1304720 | * | 10/1962 | (FR) | 431/349 |
| 60-11012 | * | 1/1985 | (JP) | 126/39 E |
| 63-38811 | * | 2/1988 | (JP) . | |
| 1067295 | * | 1/1984 | (SU) | 431/354 |
| WO 95/08738 | * | 3/1995 | (WO) . | |

* cited by examiner

*Primary Examiner*—Carl D. Price
(74) *Attorney, Agent, or Firm*—Watts Hoffmann Fisher & Heinke

(57) ABSTRACT

The inventive burner can receive air and fuel and discharge a fuel/air mixture for combustion at a periphery of the burner while limiting NOx emissions. The burner has a central axis and includes first and second plates constructed and arranged so as to form between them a central chamber and a plurality of burner ports extending outwardly of the chamber. The first and second plates have an outer periphery spaced outwardly from the central axis. The second plate indudes an opening for receiving the air and fuel into the chamber. The outer periphery of the second plate extends from the central axis by a greater distance than the outer periphery of the first plate. The second plate has an outer peripheral portion in which a plurality of openings may be formed. Also included is a method for operating the burner so as to limit NOx emissions.

25 Claims, 3 Drawing Sheets

LOW NOX BURNER

FIELD OF THE INVENTION

The present invention is directed to a burner and, in particular, to a bumer designed to have low NOx emissions.

BACKGROUND OF THE INVENTION

Burners such as those employed in domestic water heaters are typically formed of two plates having a chamber between them when the plates are fastened together. The burner includes a central axis and the upper and lower plates include outer peripheries that are radially spaced from the central axis. The lower plate includes an opening for air and fuel to enter the chamber. A bracket is fastened to the lower plate for securing the burner in place. A plurality of ports extend radially outwardly from the chamber.

The products of complete combustion are carbon dioxide, water and, in the presence of excess air, nitric oxides, which include nitric oxide (NO) and nitrogen dioxide ($NO_2$) (collectively referred to as NOx). The primary source of nitrogen is the air, both primary and secondary, required to combust gaseous fuels. The mechanism for formation of oxides of nitrogen is dissociation of nitrogen during the combustion process at flame temperatures in excess of 2600° F. and reaction with oxygen present. Nitrogen dioxide in particular is undesirable in that it is a toxic gas and a major constituent of smog. Some states have laws that require water heater burners to have low levels of NOx not greater than 40 Ng/j. Therefore, burners are designed to reduce NOx emissions and achieve suitable combustion efficiency.

One way that gas burners have been designed in an attempt to reduce NOx emissions is to position a portion of the burner in a flame hot zone. This is intended to lower the temperature of the combustion reaction to a point below that which is conducive to NOx formation. Bumer portions placed in the path of the flame in an attempt to reduce flame temperature include rods and a descending peripheral edge of the upper plate, as disclosed in U.S. Pat. No. 5,913,675. However, such burners are typically effective in only specific water heaters, and do not necessarily produce the same emissions when applied to heaters made by various manufacturers. The location of the flame hot zone is believed to move as a result of different conditions including input rate, distance the buner is located from the tank wall, shape of the combustion chamber and the method and amount of secondary air introduced into the combustion chamber. When the location of the hot zone changes due to a change in flame geometry such that the burner portion is not positioned in the flame hot zone, NOx emissions rise above legislated levels. This renders such burners unacceptable for use in a variety of water heaters.

There is a need in the industry for a gas burner which achieves acceptably low NOx emissions when used in a variety of sizes and in water heaters made by various manufacturers, while achieving suitable combustion efficiency.

SUMMARY OF THE INVENTION

In general, the present invention is directed to a burner that can receive air and fuel and discharge a fuel/air mixture for combustion at a periphery of the burner while limiting NOx emissions. The burner has a central axis and includes first and second plates constructed and arranged to form a central chamber between them and a plurality of burner ports extending outwardly of the chamber. The first and second plates each have an outer periphery spaced outwardly from the central axis. An opening is disposed in the second (e.g., lower) plate for receiving the air and fuel into the chamber. The outer periphery of the second plate extends outwardly from the central axis by a greater distance than the outer periphery of the first plate. In preferred form, the second plate may have an outer peripheral portion in which a plurality of spaced (secondary) openings are formed. The inventive burner design advantageously utilizes a mechanism that reduces the temperature of the flame thereby reducing NOx emissions without requiring that portions of the burner be consistently located in a hot zone of the flame.

Particular features of the inventive burner will now be described. The first plate may include an outer peripheral portion that extends toward the outer peripheral portion of the second plate to enable deflection of flame resulting from combustion of the fuel/air mixture without reducing a temperature of the flame effective to significantly reduce NOx emissions as a result of the deflection. The outer peripheral portion of the first plate extends outwardly from the central axis by a greater distance than the secondary air openings. The outer peripheral portion of the second plate may comprise an inner annular portion that extends from the ports at an angle away from the first plate and an annular lip portion that extends outwardly from the inner annular portion. The fuel/air mixture travels in each of the ports along a flow path, and each secondary air opening may be located in one of the flow paths. The first and second plates may have generally circular shapes.

Many advantages are achieved by the inventive burner. The invention does not suffer from the problem of not being able to consistently locate a portion of the burner in a flame hot zone in water heaters by different manufacturers and in different sizes of burners. The present burner employs a different mechanism for reducing NOx emissions. In general, the outer peripheral portion of the upper plate deflects the flame downwardly so that it rides on the long outer peripheral portion (e.g., lip) of the lower plate. The lower plate, being cooled by secondary air flow, acts as a heat sink which reduces the temperature of the flame. A contributing factor to the mechanism may also be that a portion of secondary air flow is delayed from reaching the flame until after the flame passes the outer edge of the lower plate. The relatively small sized secondary openings act to meter the secondary air in order to facilitate the combustion process, although the inventive design may facilitate the combustion reaction and low NOx emissions even without secondary air openings. According to the foregoing, the inventive burner may achieve low NOx emissions not more than 40 Ng/j and even significantly lower, throughout a variety of water heater designs and burner sizes.

In general, a method of operating the burner to limit NOx emissions according to the present invention indudes directing air and fuel into the central chamber thereby forming a fuel/air mixture and directing the fuel/air mixture through the plurality of ports. Flame formed as a result of combustion of the fuel/air mixture travels on the outer peripheral portion of the second plate, effective to reduce its temperature.

More specific aspects of the present method will now be described. Unlike the burner disclosed in the 5,913,675 patent, the flame may be deflected against the outer peripheral portion of the first plate without reducing the temperature of the flame effective to significantly reduce NOx emissions as a result of the deflection. The lip portion is cooled by the secondary air flowing along the underside of the lower plate and is believed to act as a heat sink which reduces the temperature of the flame as it travels on the lip. Also, since only a limited portion of secondary air is introduced through the small secondary openings in th second plate, the balance or major portion of secondary air that reaches the flame around the lower peripheral edge, is not introduced until flame is below the reaction temperature for dissociation of nitrogen and formation of oxides of nitrogen. In the case where no secondary openings are used, the secondary air cools the lip to achieve the heat sink effect and is limited from contacting the flame in that it is introduced around the elongated outer peripheral portion of the second plate. Thus, the present invention strikes a balance between the need for sufficient secondary air to facilitate combustion and to avoid CO production, while maintaining low flame temperature and thereby reducing NOx emissions by limiting the secondary air from reaching the flame.

A preferred embodiment of the present method includes directing the air and fuel through the opening of the second plate into the chamber, thereby forming a fuel/air mixture. The fuel/air mixture is directed from the chamber through the plurality of ports and the flame is formed as a result of its combustion. The secondary air is limited from reaching the flame by introducing the first portion of the secondary air to the flame through the openings located in the outer peripheral portion of the second plate. The flame travels along the outer peripheral portion of the second plate effective to reduce its temperature. The second balance portion of the secondary air is introduced to the flame from around the outer peripheral portion of the second plate.

Other embodiments of the invention are contemplated to provide particular features and structural variants of the basic elements. The specific embodiments referred to as well as possible variations and the various features and advantages of the invention will become better understood from the accompanying drawings together with the detailed description that follows.

DETAILED DESCRIPTION OF PREFERRED EMBODIMENTS

Figure 1:
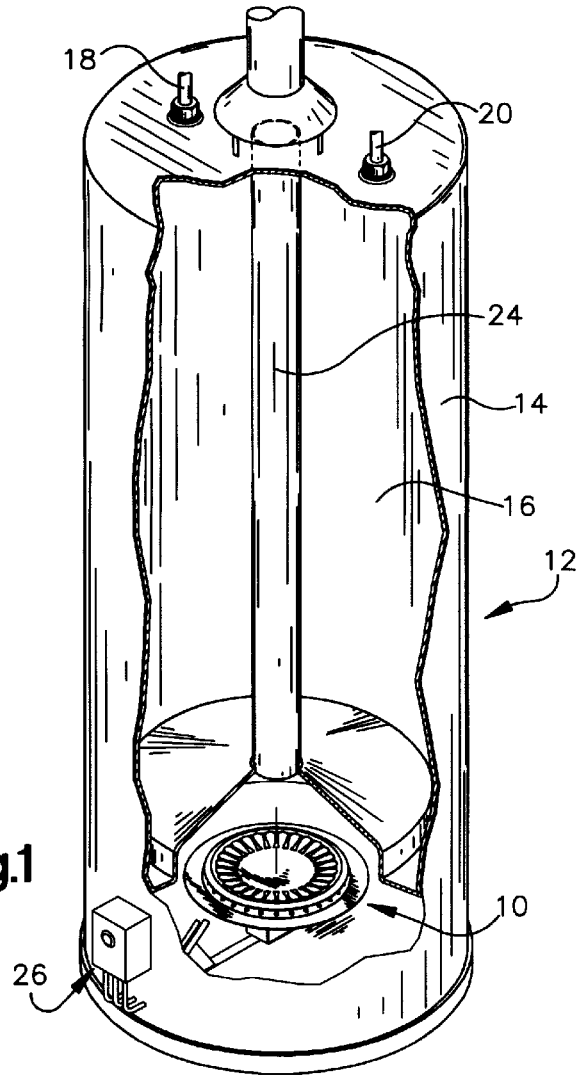
FIG. 1 is a perspective view of a water heater with a burner constructed in accordance with the present invention.
Figure 2:
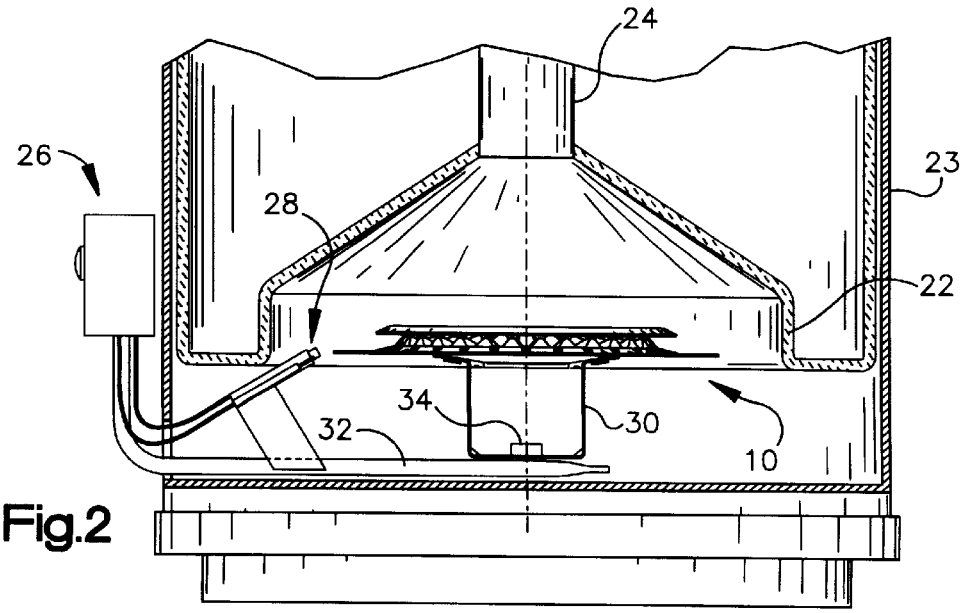
FIG. 2 is a vertical cross-sectional view of the apparatus of FIG. 1.
Figure 5:
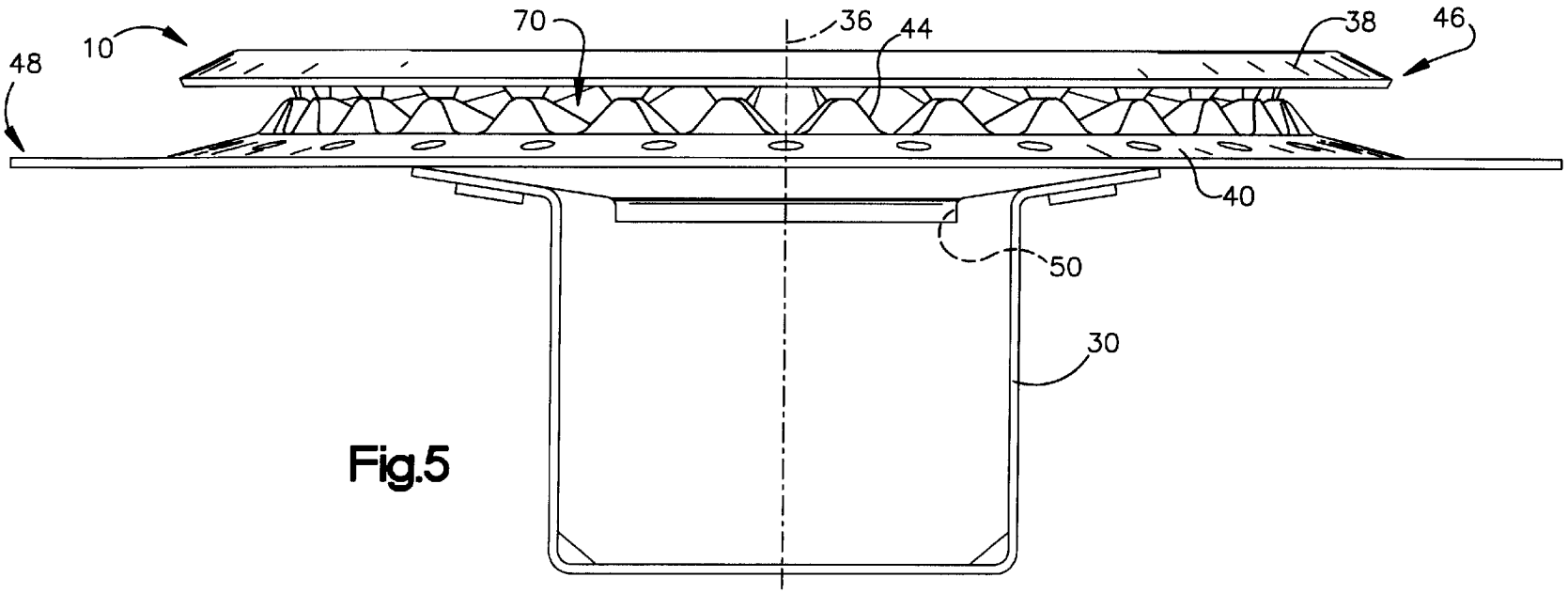
FIG. 5 is a side view as seen along the lines and arrows designated 5—5 in FIG. 3.

Referring now to the drawings and to FIGS. 1, 2 and 5 in particular, a burner constructed according to the present invention is shown generally by reference numeral 10. The burner is used in a water heater 12 which includes a tank 14 forming an enclosure 16 for containing water. The tank is connected to a cold water intake 18 and to an outlet pipe 20 leading to a commercial or domestic water system. The tank includes an interior wall 22, exterior wall 23 and a central exhaust flue 24, which is vented in the conventional manner. The water heater includes commercially available temperature control devices shown generally by reference numeral 26 including thermostats, thermocouples and switches. A pilot 28 produces flame for ignition of gas emitted from the periphery of the bumer and is controlled in a known manner. A mounting bracket 30 is attached to a gas conduit 32 below the burner such as by welding of other suitable fastening. The gas conduit includes a discharge nozzle 34 that is generally axially aligned with the bumer. The burner can receive primary air and gas, and discharge an gas/air mixture at a periphery of the burner for combustion while limiting NOx emissions.

Figure 3:
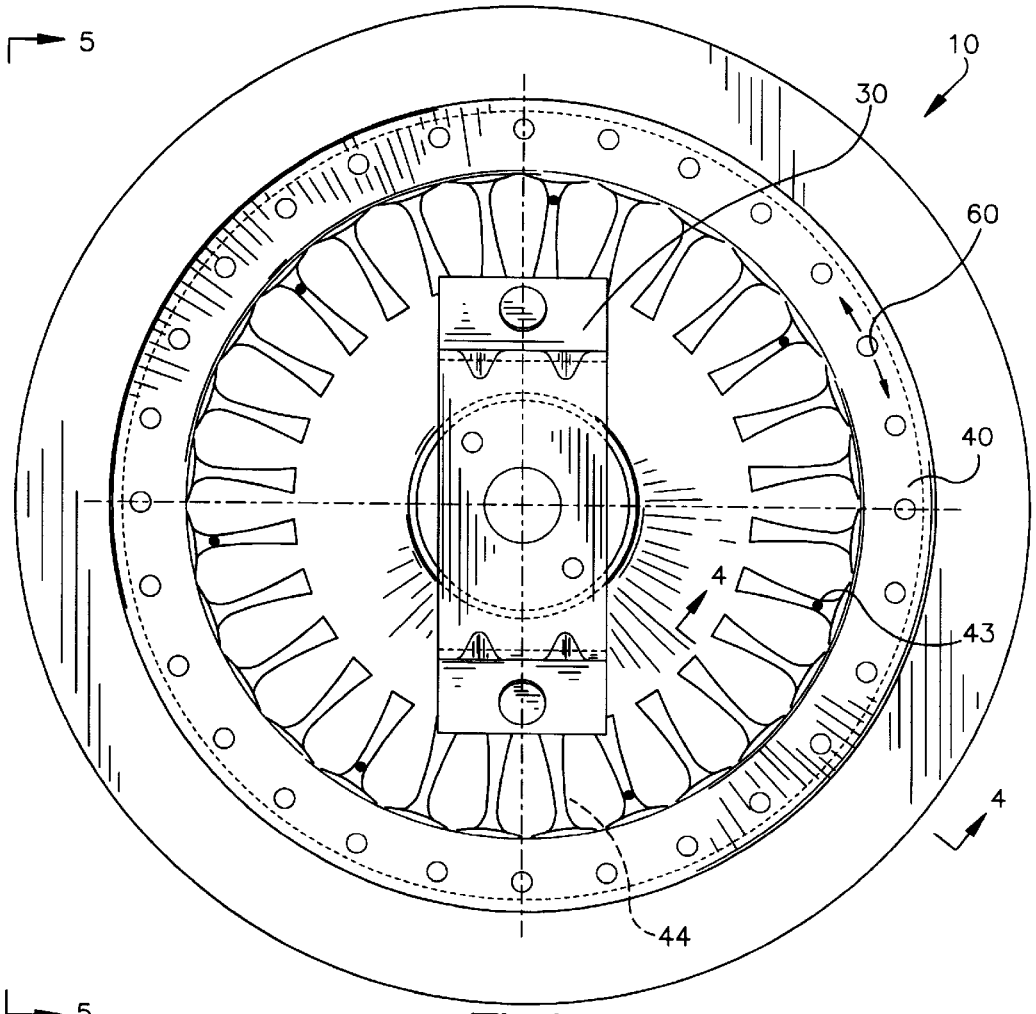
FIG. 3 is a bottom plan view of the burner of FIG. 1.

The burner has a central axis 36 and comprises upper and lower generally circular plates 38, 40 constructed and arranged so as to form between them a central chamber 42. The upper and lower plates are fastened together as by rivots 43 or spot welding in the known manner. A plurality of burner ports 44 (only one of which is labeled for clarity) extend radially outwardly from the chamber (FIG. 3). Each of the upper and lower plates has an outer periphery 46, 48 spaced radially from the central axis. The lower plate includes a central lower opening 50 for receiving air and gas.

Figure 4:
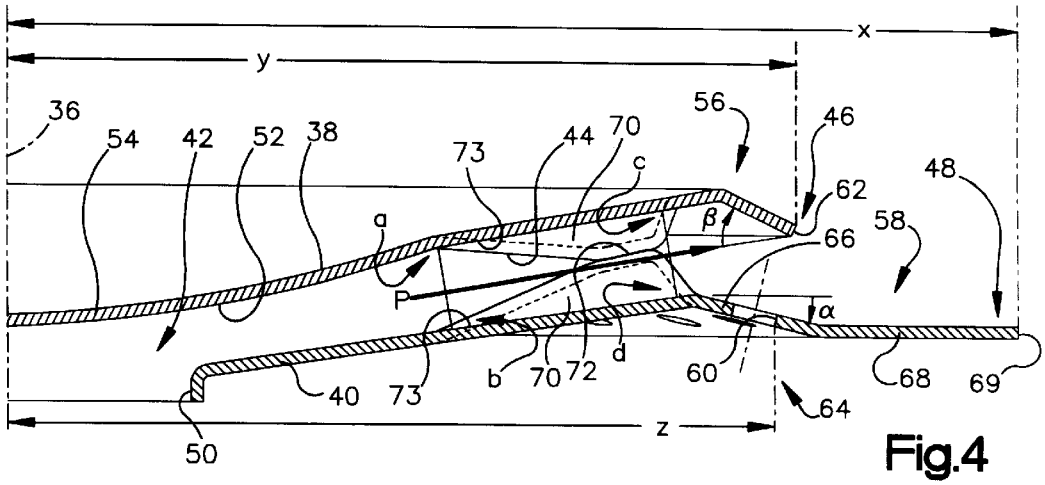
FIG. 4 is a cross-sectional view of the burner as seen from the lines and arrows designated 4—4 in FIG. 3.

The gas may be natural gas, propane or the like. At this time there is no legislation requiring the reduction of NOx emissions from combustion of any other gases except for natural gas. The gas is supplied through the conduit and travels through the nozzle or orifice. Primary combustion air is entrained along with the gas leaving the nozzle. The air and gas travel into the lower opening of the burner and enter the chamber inside the bumer. The upwardly flowing air and gas impinge upon an inner surface 52 of a central concave portion 54 of the upper plate (FIG. 4). The resulting air/gas mixture then flows uniformly radially outwardly in all directions through the plurality of ports.

The outer periphery of the lower plate extends radially outwardly from the central axis by a distance x that is greater than a distance y by which the outer periphery of the upper plate extends from the central axis. Disposed near the outer peripheries of each of the upper and lower plates are outer peripheral portions 56, 58. A plurality of circumferentially spaced secondary openings 60 (only one of which is labeled in the drawings for clarity) are formed in the outer peripheral portion 58 of the lower plate.

The outer peripheral portion 56 of the upper plate extends at a descending angle toward outer the peripheral portion 58 of the lower plate. A terminal edge 62 disposed at the upper periphery 46 extends radially outwardly from the central axis by the distance y, which is greater than a distance z of an outermost point 64 at which the openings are located from the central axis. In other words, the secondary air openings 60 are preferably located inwardly of the terminal portion 62 of the upper plate, although this should not be construed as a requirement.

The lower outer peripheral portion 58 is comprised of an inner annular portion 66 that extends from the ports and an annular lip portion 68 that extends radially outwardly from the inner annular portion. The secondary air openings 60 are disposed in the inner annular portion 66 and act to stage or delay the secondary air from reaching the flame. The secondary air is comprised of air that flows upwardly outside of the bumer. The flow of secondary air is typically created by draft up the flue but may be created in higher capacity systems using a combustion blower located on top of the water heater at the flue outlet. A first portion of the secondary air is limited in reaching the flame in that it travels through the relatively small secondary openings. The balance or second portion of secondary air is limited in reaching the flame in that it travels around at least a portion of the lip 68 of extended length and around edge 69 before reaching the flame.

The inner annular portion 66 extends from the ports to the lip along a descending angle α of, for example, preferably about 15 degrees from horizontal. The size of the angle α may vary so long as the flame is able to ride on the lip effective to impart a cooling effect on the flame which contributes to a reduction in NOx emissions. This cooling effect is believed to result from the lip acting as a heat sink for the flame. That is, the lip is cooled by contact with secondary air and thus the flame is cooled as a result of heat transfer with the lip.

Larger burners used in water heaters may face space constraints which dictate that the length of the lower lip should be proportionally less on scale-up than the length of the lower lip of a smaller burner. In such larger burners, the lower lip may be spaced apart more from the upper peripheral edge by setting the angle α steeper (i.e., at a greater value). For example, the inner annular portion may extend at an angle α of about 27 degrees in a larger burner compared to about 15 degrees in smaller burners. This will satisfy the space constraints of the larger burners and enable the lower lip to be shorter. In addition, it will prevent the flame from impinging too soon on the lower lip, which prevents adversely affecting the combustion reaction, as by raising the carbon monoxide (CO) level. The angles α, β and lengths of the inner annular portion 62 and lip 68 are able to be varied somewhat from what is shown and described herein such as in burners of different sizes and applications, as would be apparent to one skilled in the art in view of this disclosure.

Referring to FIGS. 4 and 5, the upper and lower plates include a plurality of continuous, generally U-shaped walls 70. When the upper and lower plates are placed against each other forming the chamber, the walls 70 contact each other at abutment surfaces 72 and form enclosures (i.e., the ports 44). Each port 44 extends from the chamber at an upward angle so as to form a flow path P, along which the fuel/air mixture generally travels. The flow path line P is determined in this disclosure by drawing lines between points a and b, as well as between points c and d (see FIG. 4). These lines are perpendicular to the surfaces 73. Then, the flow path line P is drawn between the midpoint of segment a–b and segment c–d. The upper outer peripheral portion 56 extends at an angle β from the flow path line P at preferably about 37 degrees in the case of the particular burner shown in FIG. 4.

The secondary air openings 60 are preferably circumferentially aligned with the flow paths of the ports as shown in FIG. 3. The openings may be moved circumferentially (i.e., in the direction of arrows shown in FIG. 3), such as to be located outside of the flow path, although this may reduce the performance of the burner. Suitable sizes, shapes and placement of the secondary openings are selected to optimize the performance of the burner and may be determined by one skilled in the art in view of this disclosure. Both a smaller burner with an input capacity of, for example, 40,000 to 50,000 Btuh and a larger burner having an input capacity of, for example, 60,000 to 100,000 Btuh, may have secondary opening diameters that would be determined so as to be suitable by those skilled in the art in view of this disclosure.

While not wanting to be bound by theory, the following describes the unique inventive method for reducing NOx emissions in a gas burner. Referring to the inventive burner of FIGS. 4 and 6B, primary air is entrained by the gas discharged from the nozzle and the air and gas enter the burner through the opening 50. The air and gas impinge upon the inner surface 52 and the resulting gas/air mixture travels from the chamber and through each port along the flow paths P. The outer peripheral portion of the upper plate extends downwardly toward the outer peripheral portion of the lower plate so as to downwardly deflect combusted gases issuing from the ports. This action is believed to inspirate a controlled amount of secondary air into the flame through the secondary air openings to assist the combustion process. The lower outer peripheral portion is continually cooled by secondary air traveling upwardly from below the burner. The flame then travels on the cooler lower outer peripheral portion 58 which acts as a heat sink, thereby lowering the temperature of the flame. Also, the bottom plate delays the introduction of secondary air to the flame by limiting the amount of a first portion of secondary air that reaches the flame to that which flows through the relatively small secondary air openings. This is believed to slow down the combustion reaction, resulting in lower flame temperature. As the balance of the secondary air passes around the outside edge 69 it mixes with the flame to further promote complete combustion. Since the flame temperature at the point at which the balance of secondary air reaches the flame is below the temperature at which nitrogen will dissociate, NOx formation is further limited. The foregoing design aspects act gradually on the flame and the combustion process and as a result, little CO gas is produced.

Figure 6B:
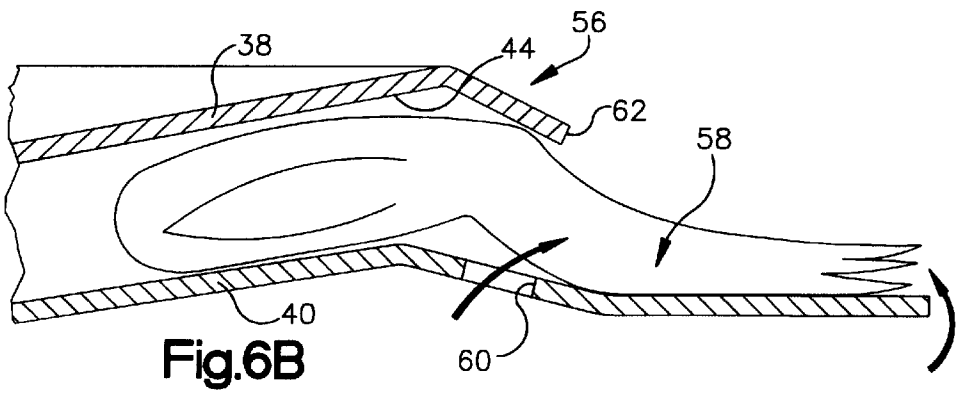
FIGS. 6A and 6B are views generally depicting the flame in one type of burner and in the inventive bumer, respectively, it being understood that actual flame from these burners may differ somewhat from what is shown without departing from the spirit of these illustrations as described herein.
Figure 6A:
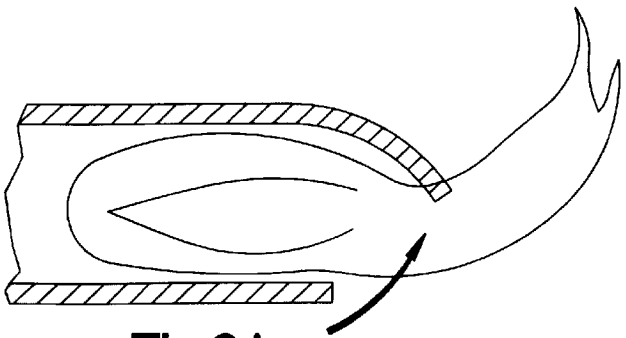

One difference between the inventive burner of FIG. 6B and the burner of FIG. 6A is that the secondary openings of the inventive burner stage or delay secondary air from reaching the flame. In FIGS. 6A and 6B the secondary air is represented by arrows. The burner of FIG. 6A, which is intended to have an upper edge placed in the flame hot zone, has little obstruction to secondary air flow and thus its performance is substantially influenced by secondary air. The deflection caused by the location and configuration of the upper outer peripheral portion 56 (FIG. 68) of the inventive burner is different than what occurs in the approach of attempting to consistently place a burner portion in the flame hot zone (FIG. 6A). It is not the intent to place the inventive upper peripheral portion 56 consistently within the flame hot zone to thereby reduce a temperature of the combusted gases effective to significantly reduce NOx emissions. The inventive upper peripheral portion 56 is intended to deflect the flame toward the elongated lip 68 which acts as a heat sink.

The inventive method for reducing NOx emissions enables the burner to be successfully used in a variety of water heater designs and so as to be scalable for use in different sizes. A principal reason for the universality of the inventive burner is that its operation is not dependent upon positioning a burner portion in the flame hot zone as in the burner of FIG. 6A. In such a burner, since the flame hot zone moves depending, inter alia, upon different water heater designs and inputs, NOx levels may not be consistently reduced to acceptably low levels. In the present invention the flame temperature may be lowered while facilitating suitable combustion, effective to reduce NOx emissions to levels below 40 nanograms/joule in a variety of water heaters and burner sizes.

Although the invention has been described in its preferred form with a certain degree of particularity, it will be understood that the present disclosure of preferred embodiments has been made only by way of example and that various changes may be resorted to without departing from the true spirit and scope of the invention as hereafter claimed.

What is claimed is:

1. A burner that can receive air and fuel and discharge a fuel/air mixture for combustion into a flame at a periphery of said burner while limiting NOx emissions, said burner having a central axis, comprising:

a first upper plate and a second lower plate constructed and arranged so as to form therebetween a central chamber and a plurality of burner ports extending outwardly of said chamber, said first plate and said second plate each having an outer peripheral edge spaced outwardly from the central axis;

said second plate including an opening for receiving said air and fuel into said chamber, the outer peripheral edge of said second plate extending outwardly from the central axis by a greater distance than the outer peripheral edge of said first plate, said first plate and said second plate having an outer peripheral portion;

a plurality of spaced openings formed in said outer peripheral portion of said second plate, said outer peripheral portion of said second plate comprising an imperforate heat sink region located outwardly of said openings and said outer peripheral edge of said first plate around an entire circumference of the burner, wherein said outer peripheral portion of said first plate is constructed and arranged relative to said ports so as to cause said flame to contact said heat sink region.

2. The burner of claim 1 wherein said outer peripheral portion of said first plate extends downwardly toward said outer peripheral portion of said second plate.

3. The burner of claim 2 wherein said fuel/air mixture travels in each of said ports along a flow path and said outer peripheral portion of said first plate extends toward said outer peripheral portion of said second plate at an angle of about 37° from said flow path.

4. The burner of claim 2, wherein said outer peripheral portion of said first plate extends toward said outer peripheral portion of said second plate to enable deflection of flame resulting from combustion of said fuel/air mixture without thereby reducing temperature of said flame effective to significantly reduce NOx emissions.

5. The burner of claim 2 wherein said outer peripheral edge of said first. plate extends outwardly from the central axis by a greater distance than said openings.

6. The burner of claim 1 wherein said fuel/air mixture travels in each of said ports along a flow path, and each of said openings is located in one said flow path.

7. The burner of claim 1 wherein said outer peripheral portion of said second plate comprises an inner annular portion that extends from said ports at an angle away from said first plate and an annular lip portion that extends outwardly from said inner annular portion.

8. The burner of claim 7 wherein said inner annular portion extends at an angle of about 15° from horizontal.

9. The burner of claim 7 wherein said inner annular portion extends at an angle of about 27° from horizontal.

10. A method of operating a burner so as to limit NOx emissions, said burner having a central axis and a first upper plate and a second lower plate, comprising:

directing air and fuel through an opening of said second plate into a central chamber of said burner formed between said first plate and said second plate and thereby forming a fuel/air mixture, each of said first plate and said second plate having an outer peripheral edge that is spaced outwardly from the central axis, said outer peripheral edge of said second plate extending from the central axis by a greater distance than said outer peripheral edge of said first plate;

directing said fuel/air mixture from said chamber through a plurality of ports that extend outwardly from said chamber;

forming a flame as a result of combustion of said fuel/air mixture;

wherein an outer peripheral portion of said first plate extends downwardly toward an outer peripheral portion of said second plate, comprising deflecting said flame against said outer peripheral portion of said first plate downwardly onto said second plate without blocking a path of said flame with a burner component that reduces temperature of said flame effective to significantly reduce NOx emissions;

causing said flame to travel along said outer peripheral portion of said second plate effective to reduce a temperature of said flame; and introducing air flowing outside said burner into said flame from around said outer peripheral edge of said second plate.

11. The method of claim 10 comprising limiting temperature of said flame as a result of limiting flow of said outside air from around said outer peripheral edge of said second plate.

12. The method of claim 10 wherein said outer peripheral portion of said second plate comprises an inner annular portion that extends from said ports at an angle away from said first plate and an annular lip portion that extends outwardly from said inner annular portion, comprising directing said flame along said lip portion.

13. A method of operating a burner so as to limit NOx emissions, said burner having a central axis and a first upper plate and a second lower plate comprising:

directing air and fuel through an opening of said second plate into a central chamber of said burner formed between said first plate and said second plate and thereby forming a fuel/air mixture, each of said first plate and said second plate having an outer peripheral edge that is spaced outwardly from the central axis, said outer peripheral edge of said second plate extending from the central axis by a greater distance than said outer peripheral edge of said first plate;

directing said fuel/air mixture from said chamber through a plurality of ports that extend outwardly from said chamber;

forming a flame as a result of combustion of said fuel/air mixture;

wherein an outer peripheral portion of said first plate extends downwardly toward an outer peripheral portion of said second plate, comprising deflecting said flame against said outer peripheral portion of said first plate downwardly onto said outer peripheral portion of said second plate;

limiting outside air flowing outside said burner from reaching said flame by introducing a first portion of said outside air to said flame through openings located in said outer peripheral portion of said second plate;

directing said flame along said outer peripheral portion of said second plate effective to reduce temperature of the flame; and introducing into said flame a second major balance portion of said outside air from around said outer peripheral edge of said second plate.

14. The method of claim 13 wherein said flame is deflected against said outer peripheral portion of said first plate onto said second plate without reducing a temperature of said flame effective to significantly reduce NOx emissions as a result of said deflection.

15. The method of claim 13 wherein said fuel/air mixture travels in each of said ports along a flow path and each of said openings is located in one said flow path.

16. The method of claim 13 wherein said outer peripheral portion of said second plate comprises an inner annular portion that extends from said ports at an angle away from said first plate and an annular lip portion that extends outwardly from said inner annular portion, comprising directing said flame along said lip portion.

17. The method of claim 13 comprising delaying said balance portion from reaching said flame until a temperature of said flame has been reduced by contact with said second plate effective to result in NOx emissions of not greater than 40 Ng/j.

18. A burner that can receive air and fuel and discharge a fuel/air mixture for combustion into a flame at a periphery of said burner while limiting NOx emissions, said burner having a central axis, comprising: first and second plates constructed and arranged so as to form therebetween a central chamber and a plurality of ports extending outwardly of said chamber, said first and second plates each having an outer peripheral edge spaced outwardly from the central axis, said second plate being disposed below said first plate and including an opening for receiving said air and fuel into said chamber, wherein the outer peripheral edge of said second plate extends outwardly from the central axis by a greater distance than the outer peripheral edge of said first plate and said first plate has an outer peripheral portion that extends downwardly toward said second plate, wherein said second plate is constructed and arranged relative to said burner ports, and extends beyond said outer peripheral portion of said first plate by a distance, which are effective to delay a major portion of air flowing outside the burner from reaching said flame until a temperature of said flame has been reduced by contact with said second plate so as to result in NOx emissions of not greater than 40 Ng/j.

19. A burner that can receive air and fuel and discharge a fuel/air mixture for combustion into a flame at a periphery of said burner while limiting NOx emissions, said burner having a central axis, comprising: first and second plates constructed and arranged so as to form therebetween a central chamber and a plurality of ports extending outwardly of said chamber, said first plate and said second plate each having an outer peripheral edge spaced outwardly from the central axis and located outwardly of said ports, said second plate being disposed below said first plate and including an opening for receiving said air and fuel into said chamber, wherein the outer peripheral edge of said second plate is located a greater distance from the central axis than the outer peripheral edge of said first plate, said second plate including an imperforate heat sink region which is located between the outer peripheral edge of said first plate and the outer peripheral edge of said second plate and around an entire circumference of the burner, said first plate having an outer peripheral portion that extends downwardly toward an outer peripheral portion of said second plate effective to deflect the flame downwardly onto said heat sink region, wherein said outer peripheral portion of said second plate is constructed and arranged relative to said ports so as to cause said flame to contact said heat sink region and to limit air outside the burner from contacting the flame effective to cool the flame and lower NOx emissions.

20. The burner of claim 19 wherein said outer peripheral portion of said second plate comprises an inner annular portion that extends from said ports at a downward angle away from said first plate and an annular lip portion that extends outwardly from said inner annular portion to the outer edge of said second plate, comprising a plurality of spaced openings disposed in said inner annular portion.

21. The burner of claim 20 wherein said fuel/air mixture travels in flow paths each formed by one of said ports, and each of said openings is located in one of said flow paths.

22. The burner of claim 19 wherein said second plate extends generally horizontally and is disposed outwardly of said outer peripheral edge of said first plate.

23. The burner of claim 19 comprising a plurality of spaced openings disposed in said second plate inwardly of said outer peripheral edge of said first plate.

24. The burner of claim 19 wherein said ports extend radially relative to the central axis.

25. A burner that can receive air and fuel and discharge a fuel/air mixture for combustion into a flame at a periphery of said burner while limiting NOx emissions, said burner having a central axis, comprising: first and second plates constructed and arranged so as to form therebetween a central chamber and a plurality of ports extending outwardly of said chamber and at an upward angle relative to a horizontal plane, said first plate and said second plate each having an outer peripheral edge spaced outwardly from the central axis and located outwardly of said ports, said second plate being disposed below said first plate and including an opening for receiving said air and fuel into said chamber, wherein said outer peripheral edge of said second plate is located a greater distance from the central axis than said outer peripheral edge of said first plate, said second plate including an imperforate heat sink region located between said outer peripheral edge of said first plate and said outer peripheral edge of said second plate around an entire circumference of the burner, said first plate having an outer peripheral portion that extends downwardly toward an outer peripheral portion of said second plate effective to deflect flame downwardly onto said heat sink region, wherein said outer peripheral portion of said second plate comprises an inner annular portion that extends from said ports at a downward angle away from said first plate and an annular lip portion that extends outwardly from said inner annular portion to said outer edge of said second plate, wherein said outer peripheral portion of said second plate is constructed and arranged relative to said ports so as to cause said flame to contact said heat sink region and to limit air outside the burner from contacting the flame effective to cool the flame and lower NOx emissions.

* * * * *